United States Patent [19]

Petersen

[11] Patent Number: 4,947,744

[45] Date of Patent: Aug. 14, 1990

[54] SCREEN PRINTING METHOD

[75] Inventor: Heino Petersen, Wabern, Switzerland

[73] Assignee: Eltex Elektrostatik GmbH, Weil am Rhein, Fed. Rep. of Germany

[21] Appl. No.: 330,600

[22] Filed: Mar. 29, 1989

[30] Foreign Application Priority Data

Mar. 31, 1988 [DE] Fed. Rep. of Germany ..... 3811143

[51] Int. Cl.[5] ..... B41M 1/12

[52] U.S. Cl. ..... 101/129; 101/123; 101/416.1

[58] Field of Search ..... 101/129, 128.4, 126, 101/416.1, 123

[56] References Cited

U.S. PATENT DOCUMENTS 4,068,585 1/1978 Thompson ..... 101/114
4,270,449 6/1981 Ito et al. ..... 101/170 X
4,275,656 6/1981 Choma ..... 101/211
4,305,331 12/1981 Colapinto ..... 101/126 X
4,589,335 5/1986 Svantesson ..... 101/126 X
4,718,340 1/1988 Love, III ..... 101/128.4 X

*Primary Examiner*—Edgar S. Burr
*Assistant Examiner*—Moshe I. Cohen
*Attorney, Agent, or Firm*—Max Fogiel

[57] ABSTRACT

A screen printing method wherein a flat article that is to be printed, printing material for example, is laid out on a printing table and secured if necessary by vacuum, a screen with a stencil that has printing ink on its upper surface is lowered with its lower surface against the article, a squeegee is scraped over the upper surface of the stencil to force ink through the screen and onto the article, the stencil is lifted, and the printed article is removed from the table. An ionizing electrode supplied with direct-current voltage is moved along with the squeegee.

11 Claims, 1 Drawing Sheet

FIG. 1
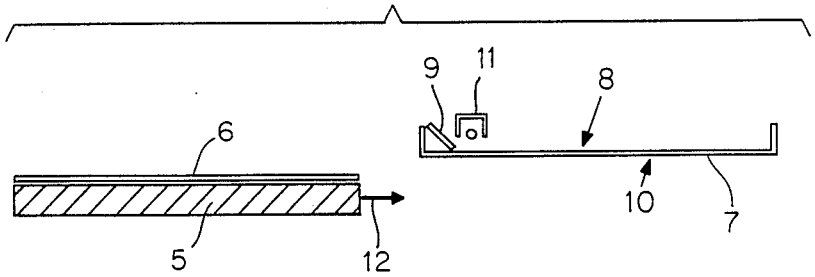
FIG. 2
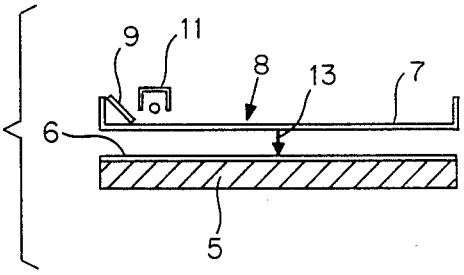
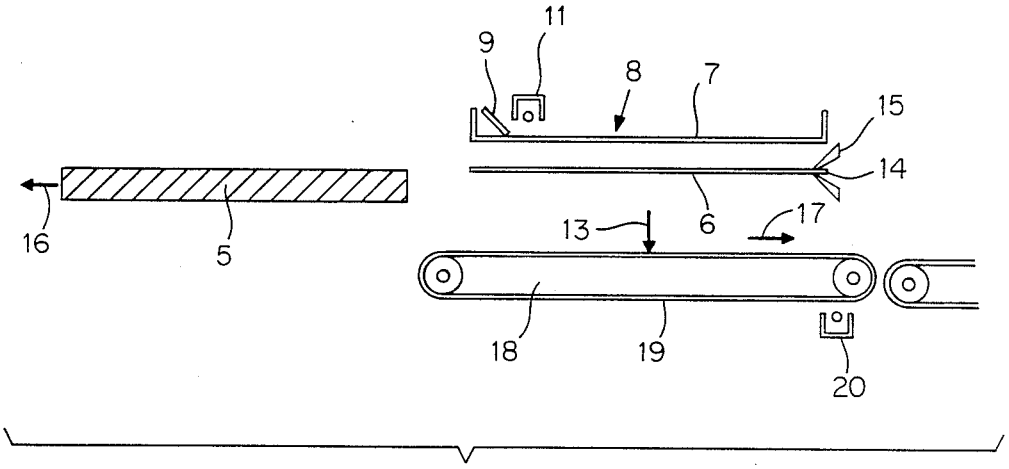
FIG. 3

SCREEN PRINTING METHOD

The invention concerns a screen printing method in accordance with the preamble to the major claim.

Some of the articles printed by known screen printing methods can lead to electrostatic charges.

A known technique for eliminating this drawback involves an electrode supplied with an alternating current. The resulting voltage also improves ink transfer.

When operations are briefly suspended in the known methods, however, drying retardants must be employed to prevent the meshes in the stencil from clogging up with dried ink. Nevertheless, it is always necessary to discontinue printing after a certain number of runs in order to remove all the ink from the screen, to add fresh ink, and to print five maculatures.

The known generic method involving the alternating-current electrode, furthermore, has considerable drawbacks. Thus, the printed article sometimes adheres at several points to the stencil when the latter is lifted, decelerating the printing process. Again, a printed article that has already been released from the stencil can be attracted back against it instead of dropping onto the conveyor belt, often smearing the ink and resulting in rejects.

The object of the present invention is accordingly to improve the generic method to the extent that it will be more rapid and will generate no waste.

This object is attained in accordance with the invention in a generic method as recited in the preamble to the major claim by means of the characteristics recited in the body. The level of ionization established in the otherwise known method will prevent the printed article from adhering to the stencil, accelerating the printing process. Furthermore, the article will not be attracted back against the stencil, and there will be less waste. Surprisingly, however, it also turns out that the screen will be more stable even without retardants, which means that no retardant will need to be added even during the normal brief suspension of operations. It also turns out that the measures employed in accordance with the invention will prevent the meshes from clogging up as rapidly. Thus, in the method in accordance with the invention, cleaning will be less frequent, downtimes shorter, less cleaning material will be used, and maculation will be reduced.

Practical embodiments and developments of the invention are recited in the subsidiary claims.

A preferred embodiment of the invention will now be described with reference to the drawing, which illustrates the various stages of the method in accordance with the invention.

BRIEF DESCRIPTION OF THE DRAWINGS

FIG. 1 is a schematic view of the essential elements for printing an article, in accordance with the present invention;

FIG. 2 is a schematic view when the arrangement, according to the present invention, is moved into position for printing;

FIG. 3 is a schematic view when the printing of the article has been completed.

FIG. 1 illustrates a printing table 5 with a flat article 6, printing material for example, laid out on it for printing. Vacuum is now applied to printing table 5 to secure the article tightly against the surface.

A stencil 7 has ink on its upper surface 8. A squeegee 9 is scraped along upper surface 8, forcing the ink through the meshes in the screen as far as its lower surface 10. An ionizing electrode 11 that is as long as squeegee 9 moves along with it and preferably slightly behind it.

Referring to FIG. 2, once the article 6 that is to be printed has been laid out on printing table 5 (FIG. 1), the table is moved along with the article in the direction indicated by arrow 12 to below stencil 7, which is then lowered in the direction indicated by arrow 13. Squeegee 9 and electrode 11 are then moved back and forth once over upper surface 8 in an unillustrated way to carry out the actual printing process.

In FIG. 3, the front edge 14 from the aspect of the first direction indicated by arrow 12 is then secured with a gripper 15, and printing table 5 is shifted opposite the direction indicated by arrow 12 and specifically in the direction indicated by arrow 16 out from between stencil 7 and a conveyor belt 18 that is positioned below the stencil and travels in a second direction indicated by arrow 17, allowing article 6, once it has been released by gripper 15, to drop onto the belt in the direction indicated by arrow 13.

There is preferably another in-itself known ionizing electrode 20 at the lower section 19 of conveyor belt 18. Each electrode comprises several pairs of individual electrodes, one at a high positive direct-current voltage and the other at a negative direct-current voltage and with each electrode in one pair next to two electrodes in the other pair, extending perpendicular to the plane of projection.

Before removing the printed article from the table, after the printing procedure has been completed, the stencil is lifted from the article.

The ionizing electrode moves always with the same speed as the squeegee.

The voltage supplied to the electrode may be a direct-current high voltage between 2 and 10 kV, or between 3 and 6 kV.

I claim:

1. A screen printing method comprising the steps of: laying out a flat article to be printed on a printing table; lowering a screen with a stencil having printing ink on an upper surface against said article so that a lower surface of said stencil contacts said article; scraping a squeegee over the upper surface of a stencil to force ink through said screen and onto said article; lifting said stencil from said article; removing the printed article from said table; moving an ionizing electrode along with said squeegee; and supplying said electrode with direction-current voltage.

2. A method as defined in claim 1, wherein said printing table is moved along with said article to be printed in one direction to a location between said stencil and a continuous conveyor belt; securing a front edge of said article in relation to the direction of motion with a gripper while said table is removed in an opposite direction after said lowering step and printing of said article, dropping said article under its own weight onto said conveyor belt for removal of said article in another direction corresponding to the direction of motion of said conveyor belt.

3. A method as defined in claim 1, wherein said ionizing electrode moves always at the same speed as said squeegee.

4. A method as defined in claim 1, wherein said ionizing electrode is as long as said squeegee.

5. A method as defined in claim 1, wherein said ionizing electrode has a plurality of individual electrodes alternately subjected to a positive and a negative direct-current voltage so that one electrode in one pair of electrodes is adjacent to two electrodes in another pair.

6. A method as defined in claim 1, wherein said direct-current voltage is a high voltage.

7. A method as defined in claim 6, wherein said high voltage is between 2 and 10 kV.

8. A method as defined in claim 6, wherein said high voltage is between 3 and 6 kV.

9. A method as defined in claim 2, wherein an additional ionizing electrode is associated with said conveyor belt.

10. A method as defined in claim 9, wherein said additional ionizing electrode is positioned below said conveyor belt and has a lower section perpendicular to said one direction and to said direction that said conveyor belt moves in.

11. A screen printing method comprising the steps of: laying out a flat article to be printed on a printing table lowering a screen with a stencil having printing ink on an upper surface against said article so that a lower surface of said stencil contacts said article; scraping a squeegee over the upper surface of said stencil to force ink through said screen and onto said article; lifting said stencil from said article; removing the printed article from said table; moving an ionizing electrode along with said squeegee; and supplying said electrode with direct-current voltage; said ionizing electrode having a plurality of individual electrodes alternately subjected to a positive and to a negative direct-current voltage so that one electrode in one pair of electrodes is adjacent to two electrodes in another pair; said printing table being moved along with said article to be printed in one direction to a location between said stencil and a continuous conveyor belt; securing a front edge of said article in relation to said direction of motion with a gripper while said table is removed in an opposite direction after lowering said stencil and printing said article; dropping said article under its own weight onto said conveyor belt for removal in another direction corresponding to the direction of motion of said conveyor belt; said ionizing electrode moving always at the same speed as said squeegee; said ionizing electrode being as long as said squeegee; said direct-current voltage being a substantially high voltage between 2 and 10 kV; an additional ionizing electrode associated with said conveyor belt; said additional ionizing electrode being positioned below said conveyor belt and having a lower section perpendicular to said one direction and said direction of motion of said conveyor belt.

* * * * *